US006390390B1

(12) United States Patent
Hung

(10) Patent No.: US 6,390,390 B1
(45) Date of Patent: May 21, 2002

(54) SPRINKLER STRUCTURE

(75) Inventor: Tsang-Chung Hung, Changhua hsien (TW)

(73) Assignee: Ruey Ryh Enterprise Col, Ltd., Changhua Hsien (TW)

( * ) Notice: Subject to any disclaimer, the term of this patent is extended or adjusted under 35 U.S.C. 154(b) by 0 days.

(21) Appl. No.: 09/934,650

(22) Filed: Aug. 23, 2001

(51) Int. Cl.[7] ..... B05B 9/01
(52) U.S. Cl. ..... 239/525; 239/526; 239/569
(58) Field of Search ..... 239/525, 526, 239/569, 289, 548, 586

(56) References Cited

U.S. PATENT DOCUMENTS 4,396,156 A * 8/1983 Southworth et al. ..... 239/526
4,618,100 A * 10/1986 White et al. ..... 239/526
4,909,443 A * 3/1990 Takagi ..... 239/526
5,984,207 A * 11/1999 Wang ..... 239/526
6,247,654 B1 * 6/2001 Kuo ..... 239/526

* cited by examiner

*Primary Examiner*—Robin O. Evans
(74) *Attorney, Agent, or Firm*—Bacon & Thomas, PLLC

(57) ABSTRACT

Water flow through a sprinkler is controlled by a valve assembly that includes a spring-biased slide shaft disposed within a valve tube and controlled by the pivotal movement of a trigger to permit accurate control of water dispensed through a barrel body by varying the separation between a stop flange of the slide shaft and a water inlet of the valve tube.

3 Claims, 5 Drawing Sheets

SPRINKLER STRUCTURE

BACKGROUND OF THE INVENTION

The present invention is related to a sprinkler structure having less components which can be easily and quickly assembled. The controlling valve assembly can be tightly and precisely fitted in the controlling valve seat without leakage. The amount of the water discharged from the sprinkler can be micro-adjusted as necessary.

FIG. 1 shows a conventional sprinkler. The controlling valve assembly is arranged in the tubular barrel body 1 of the sprinkler. A thread rod 2 rearward extends from the barrel body 1. A controlling trigger 4 is pivotally connected with back side of the tubular handle 3. The top end of the controlling trigger 4 via a nut 5 chucks the thread rod 2. In operation, a user's hand holds the controlling trigger 4 and the handle 3 and presses the trigger 4 to drive the thread rod 2 for operating the controlling valve assembly inside the barrel body 1.

The above conventional sprinkler structure has some shortcomings as follows:

1. In operation, the thumb of the user presses the trigger 4 to open or close the sprinkler. Such operation is not easy to perform.
2. When it is necessary to adjust the amount of the sprinkled water, the user needs to adjust the nut 5 at the top of the trigger 4. It is inconvenient for the user to perform such adjustment.

FIG. 2 shows another conventional sprinkler. The barrel body 11 and the handle 12 communicate with each other. The barrel body 11 and the handle 12 are integrally coated with a plastic layer to form the sprinkler main body 10. The front end of the barrel body 11 is formed with a thread section 13 for connecting with a sprinkling head 14. The rear end of the handle 12 is formed with inner thread 15 for connecting with a water hose. A controlling valve tube seat 20 is disposed in upper section of the handle 12 and positioned at an adjoining section between the handle 12 and the barrel body 11. The inner end of the valve tube seat 21 integrally communicates with the barrel body 11 and the handle 12. The inner face of outer end of the valve tube seat 21 is formed with symmetrical locating dents 22. A spring 35 and a cylindrical valve tube member 23 are fitted in the valve tube seat 21. The valve tube member 23 is formed with protuberances 24 corresponding to the locating dents 22 of the valve tube seat 21. The valve tube member 23 is inserted in the valve tube seat 21. One side of the inner end of the valve tube member 23 is formed with a through hole 26 facing the barrel body 11. The other side thereof is formed with a notch 25 facing the handle 12. The notch 25 is deflected from the through hole 26 by a certain distance. The slide shaft hole 27 in the valve tube member 23 within the deflection distance between the notch 25 and the through hole 26 is enlarged to form an annular step 28. The circumferential face of the valve tube body 23 opposite to the inner side of the protuberances 24 and the deflection distance between the notch 25 and the through hole 26 is respectively formed with an annular groove 29 in which a water-sealing ring 30 is fitted to slidably watertight attach to the valve tube seat 21. A slide shaft 31 is passed through the slide shaft hole 27 of the valve tube member 23. The front end thereof protrudes from the valve tube member 23. The circumference of the rear end of the slide shaft 31 is formed with an annular stop flange 32. The slide shaft 31 is formed with an annular groove 29 on front side of the stop flange 32 in which a water-sealing washer 33 is fitted for watertight attaching to the annular step 28 of the slide shaft hole 27. The middle section of the slide shaft 31 is formed with an annular neck groove 34 with a width bridging over the notch 25 and the through hole 26 of the valve tube member 23. The front section of the slide shaft 31 is formed with an annular groove 29 in which a water-sealing ring 30 is fitted for slidably watertight attaching to the inner wall face of the slide shaft hole 27.

The above conventional structure has some shortcomings as follows:

1. The sprinkler has numerous components and it is troublesome to assemble these components.
2. In the case of little error of the dimension of the components, the assembly of the components will have poor watertight effect. As a result, when operating the sprinkler, water will leak therefrom.

SUMMARY OF THE INVENTION

It is therefore a primary object of the present invention to provide an improved sprinkler structure having less components which can be easily and quickly assembled.

It is a further object of the present invention to provide the above sprinkler in which the components can be assembled at high precision without leakage.

It is still a further object of the present invention to provide the above sprinkler which can be maintained in a state of maximum water flow or a water-sealing state. In addition, the amount of the discharged water can be micro-adjusted as necessary. Therefore, the sprinkler can be conveniently operated.

The present invention can be best understood through the following description and accompanying drawings wherein:

DETAILED DESCRIPTION OF THE PREFERRED EMBODIMENT

Figure 1:
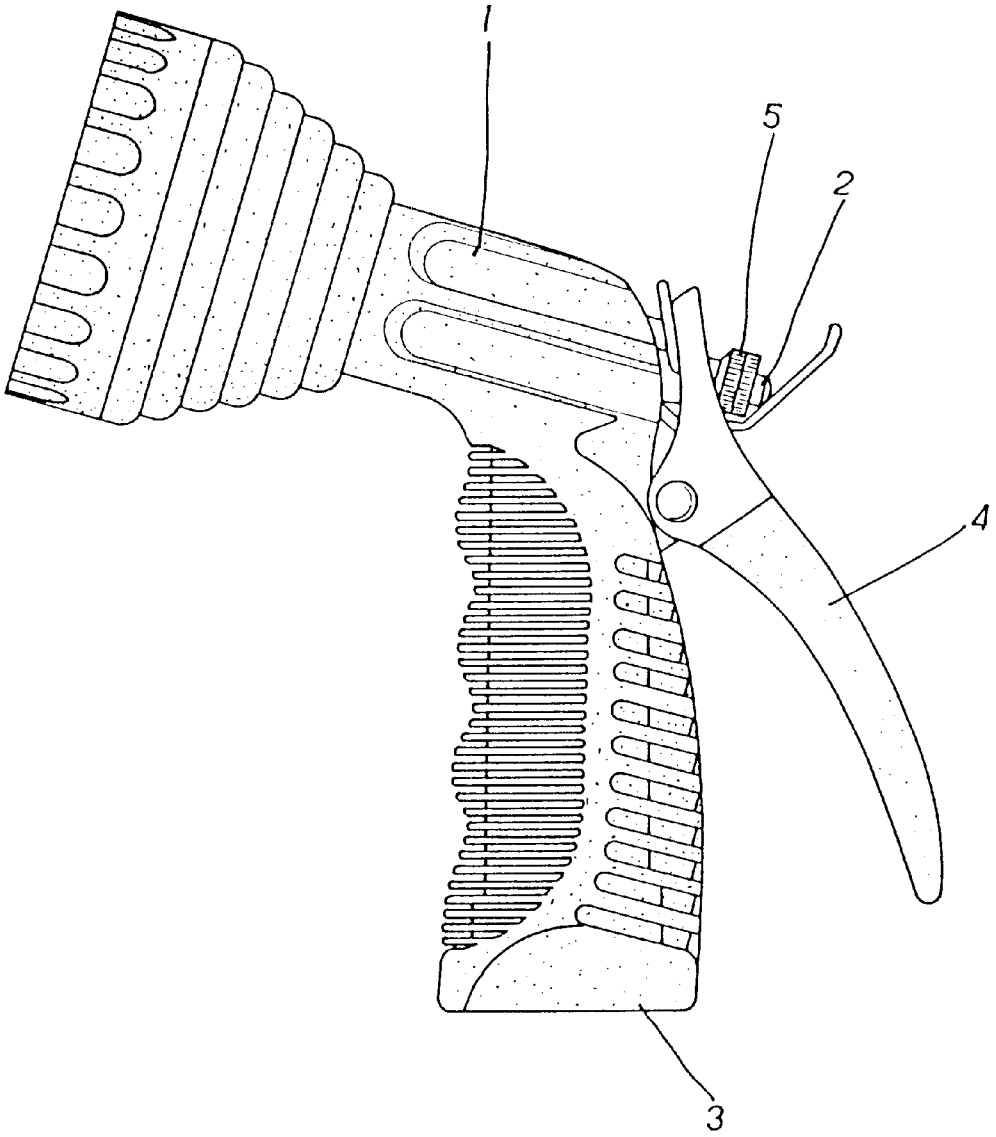
PRIOR ART FIG. 1
FIG. 1 is a side view of a conventional sprinkler.
Figure 2:
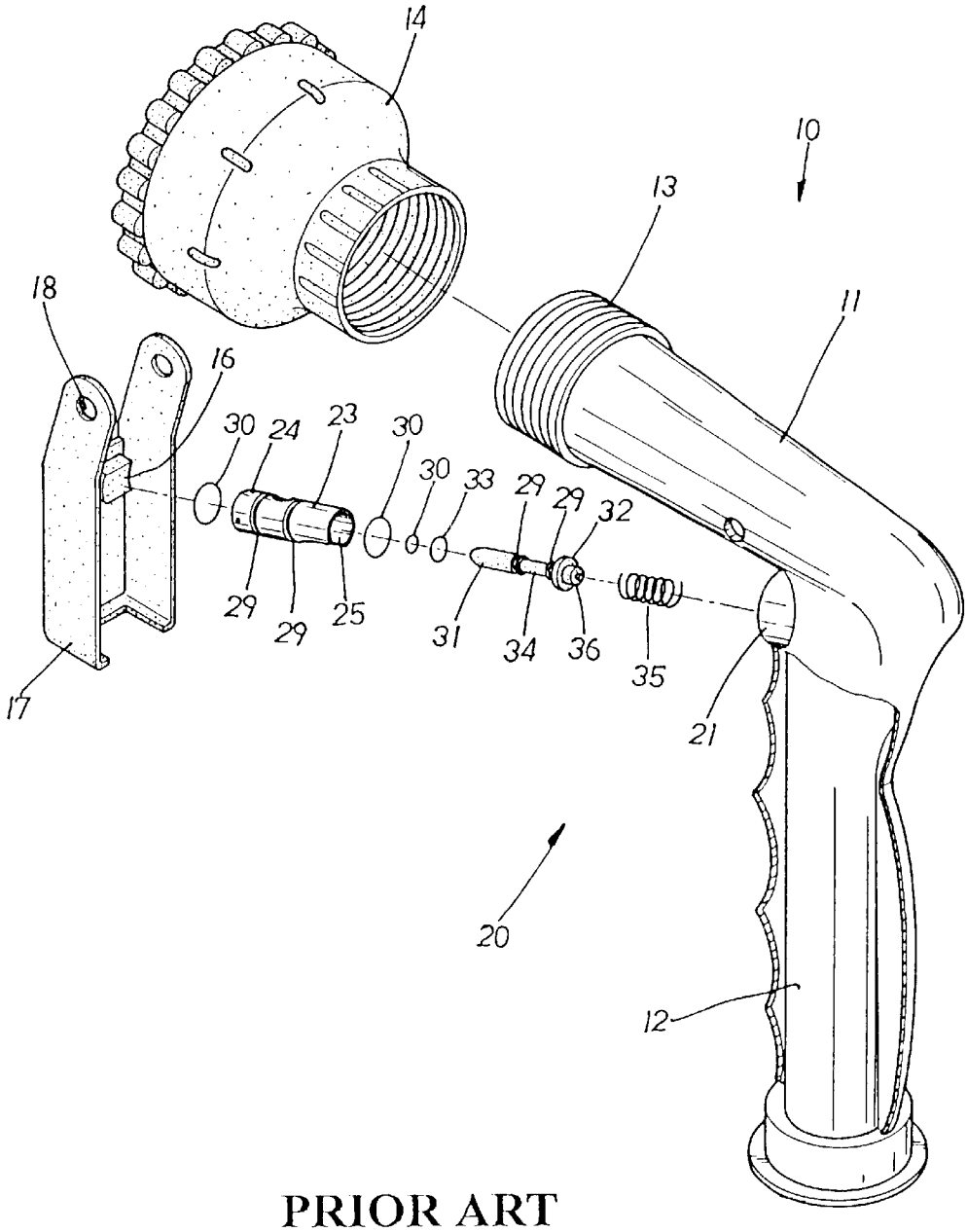
PRIOR ART FIG. 2
FIG. 2 is a perspective exploded view of another type of conventional sprinkler.
Figure 3:
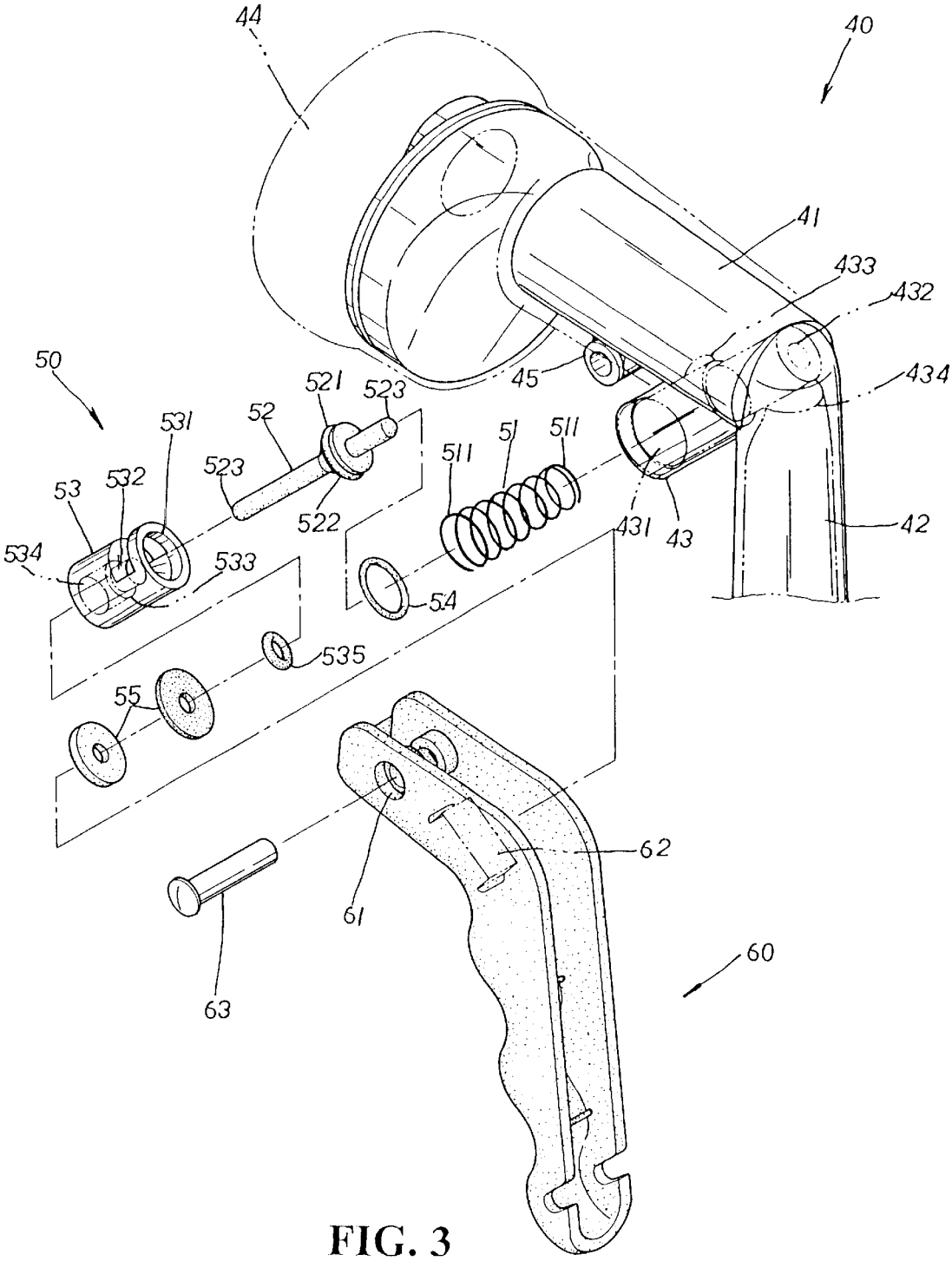
FIG. 3 is a perspective assembled view of the present invention.
Figure 4:
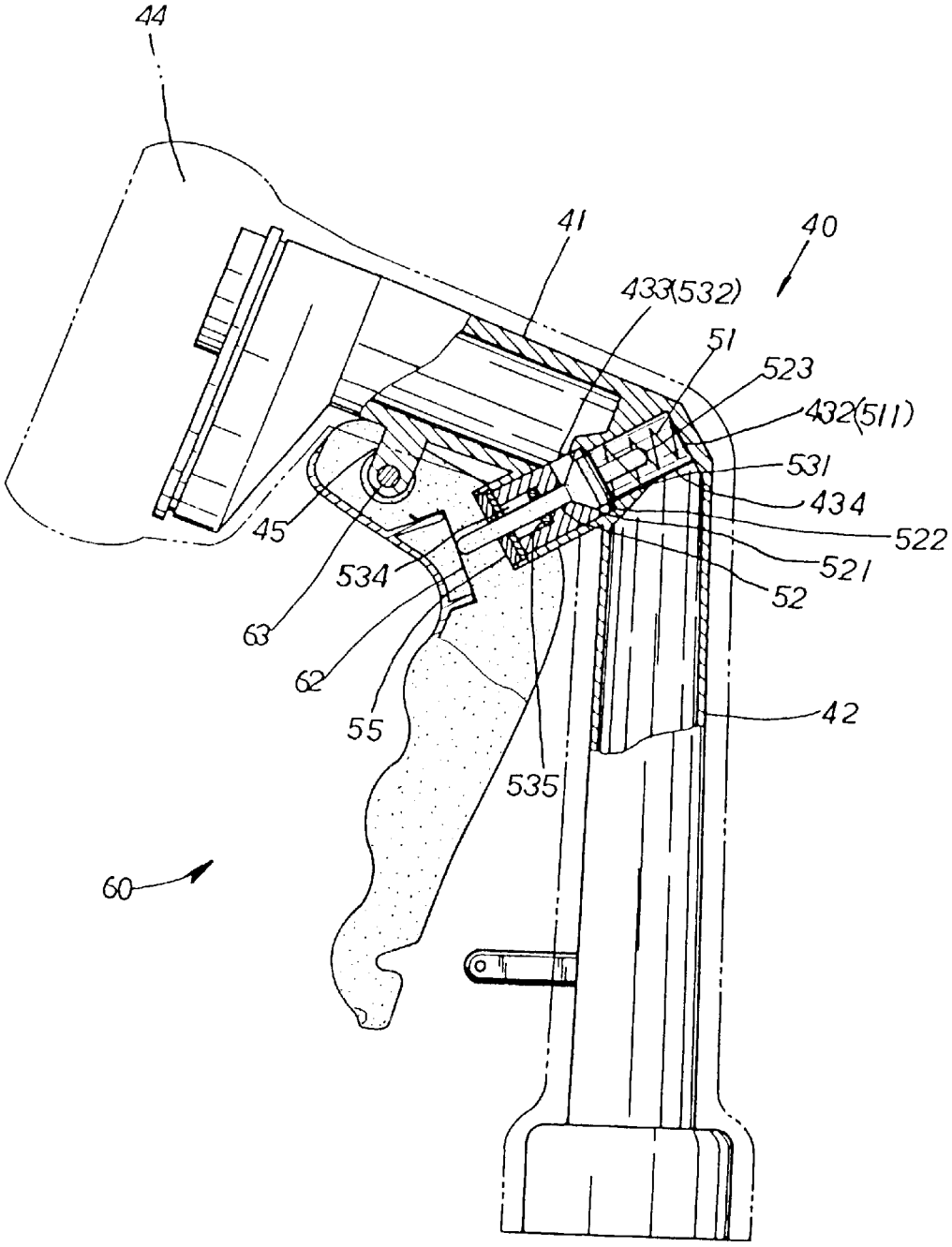
FIG. 4 is a sectional assembled view of the present invention.

Please refer to FIG. 3. The sprinkler structure of the present invention includes a main body 40, a controlling valve assembly 50 and a trigger 60. The main body 40 is integrally coated with a plastic layer. A controlling valve seat 43 is disposed at the adjoining section between the upper section of the handle 42 and the barrel body 41. The controlling valve seat 43 is formed with a stepped hole 431. The upper side of the stepped hole 431 is formed with a water outlet 433 under the barrel body 41. The upper side of the handle 42 is formed with a water inlet 434. The top end of the controlling valve seat 43 is provided with a locating section 432 for receiving the controlling valve assembly 50 therein. A locating seat 45 downward extends from the middle of the barrel body 41. One end 511 of a conic spring 51 of the controlling valve assembly 50 abuts against the locating section 432. The stop flange 521 of the slide shaft 52 is fitted with a washer 522 to abut against the water inlet 531 of the controlling valve tube 53. The slide shaft 52 is fitted into a washer 54 and then one end 523 of the slide shaft 52 abuts against the other end 511 of the conic spring 51. The other end 523 of the slide shaft 52 is passed through the stepped through hole 533 of the controlling valve tube 53. The controlling valve tube 53 is formed with a semicircular water outlet 532 behind the water inlet 531. The water outlet 532 is upward aimed at the water outlet 433 in the controlling valve seat 43 and then inward pressed and tightly engaged therewith. Then, a small washer 535 is fitted and located in the large diameter section 534 of the stepped through hole 533. Then, two washers 55 are fitted therein. The other end 523 of the slide shaft 52 abuts against the press plate 62 in the trigger 60. The through hole 61 of the trigger 60 is aligned with the locating seat 45 of the main body 40 and pivotally connected therewith by a rivet 63.

Figure 5:
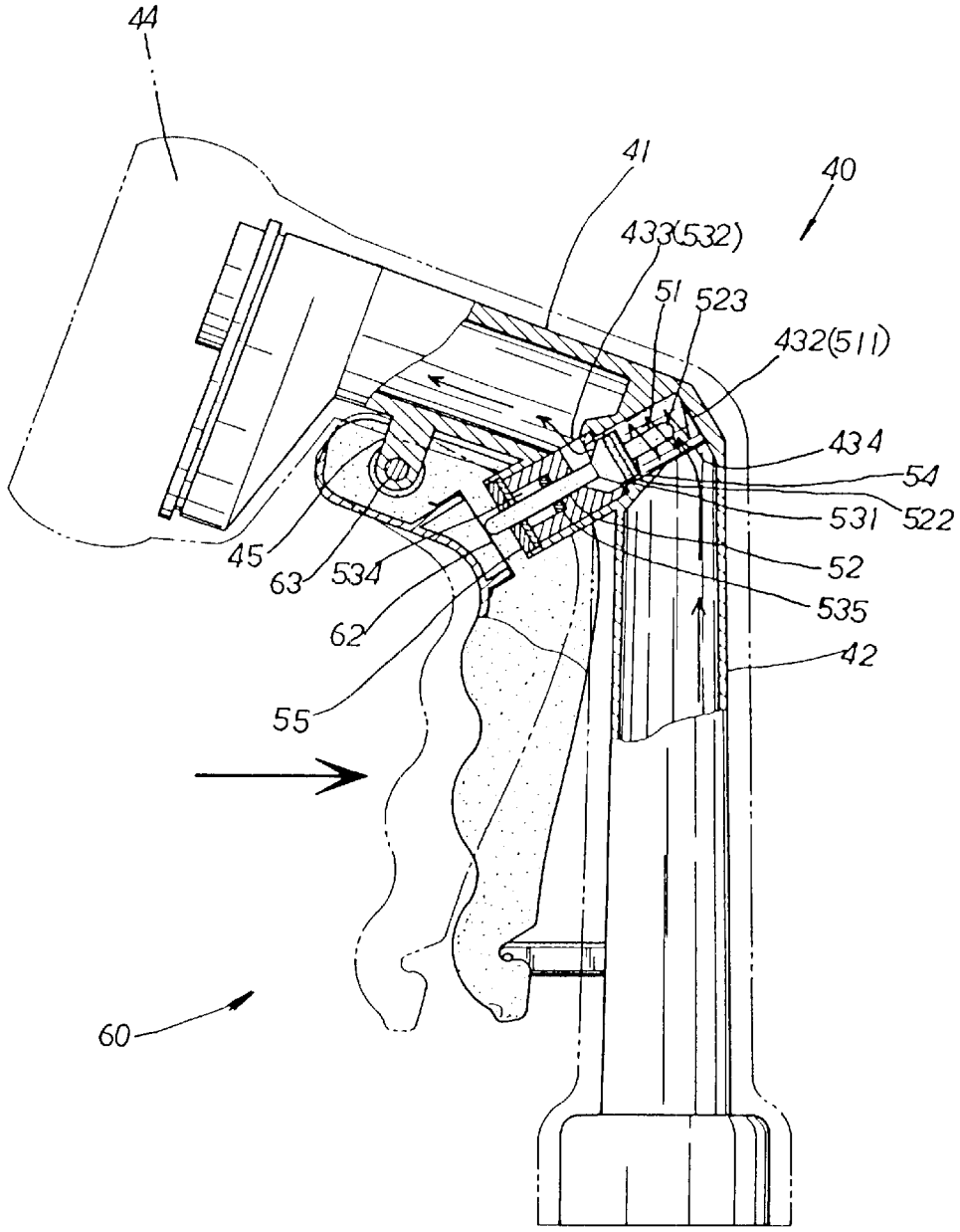
FIG. 5 is a sectional assembled view according to FIG. 4, showing the operation of the present invention.

Referring to FIG. 5, when controlling and using the sprinkler, the trigger 60 is pressed toward the handle 42 of the main body 40 to make the press plate 62 of the trigger 60 abut against one end 523 of the slide shaft 52. The stop flange 521 of the slide shaft 52 is separated from the water inlet 531 of the controlling valve tube 53. At this time, the water can flow through the water inlet 434 of the handle 42 into the controlling valve seat 43. The water passes through the water inlet 531 of the controlling valve tube 53 and discharges from the water outlet 532 of the controlling valve tube 53. The water then passes through the stepped hole 431 and injects from the water outlet 433 of the barrel body 41. By means of controlling the depth by which the trigger 60 is pressed toward the handle 42, the amount of the discharged water can be controlled. When the slide shaft 52 is pressed by the trigger 60, the distance between the stop flange 521 and the water inlet 531 of the controlling valve tube 53 is variable to change the amount of the discharged water. Such operation is easy.

According to the above arrangement, the present invention has the following advantages:

1. The sprinkler has less components which can be easily and quickly assembled.
2. The components can be assembled at high precision without leakage.
3. The sprinkler can be maintained in a state of maximum water flow or a water-sealing state. In addition, the amount of the discharged water can be micro-adjusted as necessary. Therefore, the sprinkler can be conveniently operated.

The above embodiment is only used to illustrate the present invention, not intended to limit the scope thereof. Many modifications of the above embodiment can be made without departing from the spirit of the present invention.

What is claimed is:

1. A sprinkler structure comprising:

a.) A main body including a barrel body and a tubular handle in communication with the barrel body, an upper side of the handle having a water inlet, and a locating seat extending from the barrel body;

b.) A trigger pivotally secured to the locating seat for movement towards and away from the handle, the trigger including a press plate;

c.) A valve seat disposed at an adjoining section between the barrel body and the handle, the valve seat including a stepped hole, an upper side of the stepped hole having a water outlet disposed below the barrel body, and a top end of the valve seat having a locating section; and d.) A valve assembly disposed within the valve seat, the valve assembly including a valve tube having a water inlet, a semi circular water outlet directed at the water outlet of the valve seat and a stepped hole, a slide shaft disposed within the valve tube and having a stop flange thereon for engaging the water inlet of the valve tube, a first portion of the slide shaft extending through the stepped hole of the valve tube and engaging the press plate of the trigger, and a conic spring surrounding a second portion of the slide shaft, the spring having a first end in engagement with the stop flange and a second end in engagement with the locating section.

2. The sprinkler structure of claim 1, wherein the valve tube is tightly fitted within the valve seat.

3. The sprinkler structure of claim 1 further including a first washer means provided on the stop flange of the slide shaft and a second washer means provided within the stepped hole of the valve tube.

* * * * *